US007882896B2

(12) United States Patent
Wilson et al.

(10) Patent No.: US 7,882,896 B2
(45) Date of Patent: Feb. 8, 2011

(54) GAS EDUCTION TUBE FOR SEABED CAISSON PUMP ASSEMBLY

(75) Inventors: Brown Lyle Wilson, Tulsa, OK (US); Christopher K. Shaw, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 746 days.

(21) Appl. No.: 11/830,263

(22) Filed: Jul. 30, 2007

(65) Prior Publication Data

US 2009/0035067 A1 Feb. 5, 2009

(51) Int. Cl.
*E21B 43/01* (2006.01)

(52) U.S. Cl. ..... 166/368; 166/344; 166/369; 166/370; 166/105.5; 166/105.6; 417/80; 417/84; 95/266; 96/193

(58) Field of Classification Search ..... 166/368, 166/339, 344, 347, 351, 369, 370, 372, 68, 166/105, 105.5, 105.6; 415/206; 417/199.2, 417/423.3, 424.2, 79, 80, 82–84; 95/266; 96/193, 204, 206
See application file for complete search history.

(56) References Cited

U.S. PATENT DOCUMENTS 4,290,736 A * 9/1981 Bernasconi ..... 417/87
4,515,180 A * 5/1985 Napolitano ..... 137/565.17
4,690,756 A * 9/1987 Van Ry ..... 210/221.2
4,704,070 A * 11/1987 Iseman ..... 417/80
4,832,127 A * 5/1989 Thomas et al. ..... 166/369
5,403,151 A * 4/1995 Noyes ..... 415/182.1
6,190,141 B1 * 2/2001 Henry ..... 417/423.3
6,357,530 B1 * 3/2002 Kennedy et al. ..... 166/369
6,361,272 B1 * 3/2002 Bassett ..... 415/121.1
6,394,183 B1 * 5/2002 Schrenkel et al. ..... 166/265
6,428,268 B1 * 8/2002 Addie et al. ..... 415/1
6,457,529 B2 * 10/2002 Calder et al. ..... 166/368
6,622,791 B2 * 9/2003 Kelley et al. ..... 166/313
6,691,782 B2 * 2/2004 Vandevier ..... 166/265
6,698,521 B2 * 3/2004 Schrenkel et al. ..... 166/369
6,736,880 B2 * 5/2004 Ford et al. ..... 95/248
6,860,921 B2 * 3/2005 Hopper ..... 95/261
6,932,160 B2 * 8/2005 Murray et al. ..... 166/369
6,971,848 B2 * 12/2005 Watson ..... 415/213.1
7,150,325 B2 * 12/2006 Ireland et al. ..... 166/366
7,481,270 B2 * 1/2009 Shepler ..... 166/105
7,597,811 B2 * 10/2009 Usher ..... 210/747
7,673,676 B2 * 3/2010 Rivas et al. ..... 166/106
2004/0129428 A1 * 7/2004 Kelley ..... 166/372
2007/0144738 A1 * 6/2007 Sugiyama et al. ..... 166/250.07
2008/0277353 A1 * 11/2008 Frosti ..... 210/744
2009/0211763 A1 * 8/2009 Fowler et al. ..... 166/357
2009/0211764 A1 * 8/2009 Fielding et al. ..... 166/357

* cited by examiner

*Primary Examiner*—Thomas A Beach
*Assistant Examiner*—Matthew R Buck
(74) *Attorney, Agent, or Firm*—Bracewell & Giuliani LLP

(57) ABSTRACT

A seafloor pump assembly is installed within a caisson that has an upper end for receiving a flow of fluid containing gas and liquid. The pump assembly is enclosed within a shroud that has an upper end that seals around the pump assembly and a lower end that is below the motor and is open. An eduction tube has an upper end above the shroud within the upper portion of the caisson and a lower end in fluid communication with an interior portion of the shroud. The eduction tube causes gas that separates from the liquid and collects in the upper portion of the caisson to be drawn into the pump and mixed with the liquid as the liquid is being pumped.

20 Claims, 2 Drawing Sheets

GAS EDUCTION TUBE FOR SEABED CAISSON PUMP ASSEMBLY

FIELD OF THE INVENTION

This invention relates in general to pumping well fluid from the seabed to the surface, and in particular to a pump assembly located within a caisson and having an eduction tube to reduce gas accumulation in the caisson.

BACKGROUND OF THE INVENTION

Offshore wells are being drilled in increasingly deeper waters. The wells may have adequate pressure to flow the well fluid to the seabed, but lack sufficient pressure to flow the fluid thousands of feet upward to a production vessel. Proposals have been made to install pumps at the seabed to boost the pressure of the well fluid sufficiently to flow it to the floating production vessel.

Often, the well fluid will be a mixture of hydrocarbon liquid, gas and water. Gas presents a problem for pumps, particularly electrically driven centrifugal pumps. Gas detracts from the efficiency of the pump, and can cause the pump to lock and shut down if a large slug of gas enters.

One proposal for dealing with well fluid having an appreciable quantity of gas is to mount the pump in a caisson. The caisson is located in a tubular bore formed into the seabed and cased to seal it from the earth formations. The caisson may be several hundred feet deep. The well fluid flows in the upper end of the caisson, and gravity causes the liquid to separate from the gas and flow downward in the caisson. The gas tends to collect in the upper portion of the caisson. The submersible pump is located within the caisson at a point where its intake is below the liquid level. The pump is enclosed by a shroud with an inlet at the lower end to force liquid to flow upward by the motor to coot the motor. As the gas cap continues to build, portions will escape and flow into the pump along with the liquid to be pumped into the surface. A possibility exists that the gas cap will grow and push the liquid level too low, resulting in a large quantity of the gas entering the pump and causing it to gas lock. Liquid level controllers have been proposed to open and close the inlet to the caisson to try to maintain the liquid at a desired level above the intake of the pump. A large gas slug could nevertheless still enter the pump and cause a gas lock.

SUMMARY OF THE INVENTION

In this invention, the pump is located within a shroud inside the caisson. An eduction tube that extends out of shroud and has an upper end for location within a portion of the caisson that normally will be a gas accumulation area above the liquid level. The eduction tube has a lower end in fluid communication with an interior portion of the shroud. During operation, the eduction tube creates a suction to draw in a small continuous quantity of gas as the pump operates to avoid the gas cap from becoming too large.

In one embodiment, the lower end of the tube joins the intake of the pump assembly within the shroud. In another embodiment, the eduction tube extends alongside the shroud and has its lower end at the inlet of the shroud. Preferably the inlet of the shroud in that instance has a venturi configuration to cause a reduced pressure. The lower end of the tube joins a point of reduced pressure in the venturi.

In another embodiment, more than one eduction tube is employed. The tubes may have their upper ends spaced at different distances above the shroud for educting gas from different points in the caisson. In another embodiment, an eduction conduit is mounted to the inlet of a caisson. The eduction conduit leads from the upper end of the caisson back to the inlet for recirculating some of the gas cap back into the well fluid flowing into the caisson. In all of the embodiments, the eduction tube or tubes are sized to have a much smaller flow area than the flow area of the inlet of the shroud, so that significant amount liquid will continue to flow into the inlet of the shroud.

DETAILED DESCRIPTION OF THE INVENTION

Figure 1:
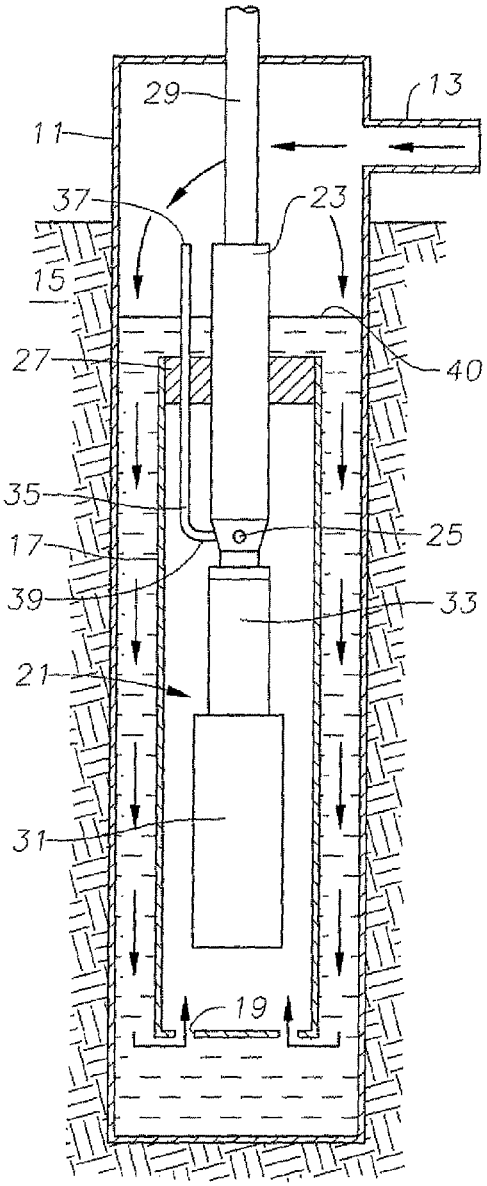
FIG. 1 is a schematic sectional view illustrating a caisson pump apparatus constructed in accordance with a first embodiment of the invention.

Referring to FIG. 1, a caisson 11 is shown schematically. Caisson 11 comprises a hole that has been formed in the seafloor to a desired depth, which may be several hundred feet. Caisson 11 is encased in a casing that is impermeable to any fluids from earth formation 15. Caisson 11 has an inlet 13 that is located near its upper end, such as slightly above the seabed.

A shroud 17 is located within caisson 11. Shroud 17 has an inlet 19 at its lower end, Shroud 17 is a tubular member that is smaller in diameter than the inner diameter of caisson 11 so as to create an annular passage surrounding it for downward fluid flow.

An electrical submersible pump assembly ("ESP") 21 is mounted within shroud 17. ESP 21 has a pump 23 that is typically a centrifugal pump. Pump 23 is made up of a large number of stages, each having a rotating impeller and a stationary diffuser. Pump 23 has an intake 25 that is located at the lower end of pump 23 within shroud 17. Shroud 17 has an upper end 27 that seals around a portion of ESP 21 above intake 25. If desired, the entire length of ESP 21 could be enclosed by shroud 17, but the upper end 27 of shroud 17 only needs to be slightly above pump intake 25. A discharge pipe 29 extends upward from pump 23 and out the upper end of caisson 11. Although shown extending through the top of caisson 11, discharge pipe 29 could alternately extend through a sidewall portion of caisson 11. ESP 21 also has an electrical motor 31 that has a shaft that drives pump 23. Motor 31 and pump 23 are conventionally separated by a seal section 33. Seal section 33 equalizes the pressure of lubricant contained in motor 31 with the well fluid on the exterior of motor 31.

An eduction tube 35 has an upper end 37 that is exterior of shroud 17. Eduction tube 35 has an inner diameter much smaller than the inner diameter of discharge pipe 29. Eduction tube 35 has a lower end 39 that is fluid communication with well fluid in the interior of shroud 17. In the first embodiment, lower end 39 extends to a portion of pump intake 25. When pump 23 is operating, a suction exists at intake 25, causing lower end 39 to have a lower pressure than upper end 37. Upper end 37 is positioned above the liquid level 40 in caisson 11 at all times. Optionally, a liquid level controller (not shown) may employed for controlling the flow of fluid into caisson 11, if desired, to maintain liquid level 40 fairly constant.

In the operation of the first embodiment, ESP 21 is placed in shroud 17 and installed in caisson 11. The valve (not shown) to inlet 13 is opened, causing well fluid to flow through caisson inlet 13. The well fluid is typically a mixture of hydrocarbon liquid, water and gas. Shroud 17 is immersed in liquid in caisson 11, with liquid level 40 being at least above pump intake 25 and preferably above shroud upper end 27. Liquid level 40 will be below caisson inlet 13. A gravity separation occurs as the fluid flows in inlet 13 and downward in caisson 11. This results in gas freeing from the liquid and collecting in the upper portion of caisson 11. The liquid flows down through the annular passage around shroud 17 and into shroud inlet 19. The liquid flows up alongside motor 31 and into pump intake 25. Pump 23 increases the pressure of the liquid and discharges it through discharge pipe 29 for flowing the liquid to the surface.

At the same time, a small amount of gas from the gas cap collecting above liquid level 40 will flow through eduction tube 35. The gas leaves eduction tube 35 and mixes with the liquid flowing into pump intake 25. The flow rate of the gas is fairly constant and relatively small compared to the liquid flow rate, thus is readily pumped by pump 23 along with the liquid up discharge pipe 29. The flow area of eduction tube 35 is much smaller than the total flow area of shroud inlet 19 so as to avoid excessive amounts of gas flowing into pump 23. Also, the small cross-sectional flow area of eduction tube 35 assures that liquid will continue to flow up around motor 31 for cooling motor 31.

Figure 2:
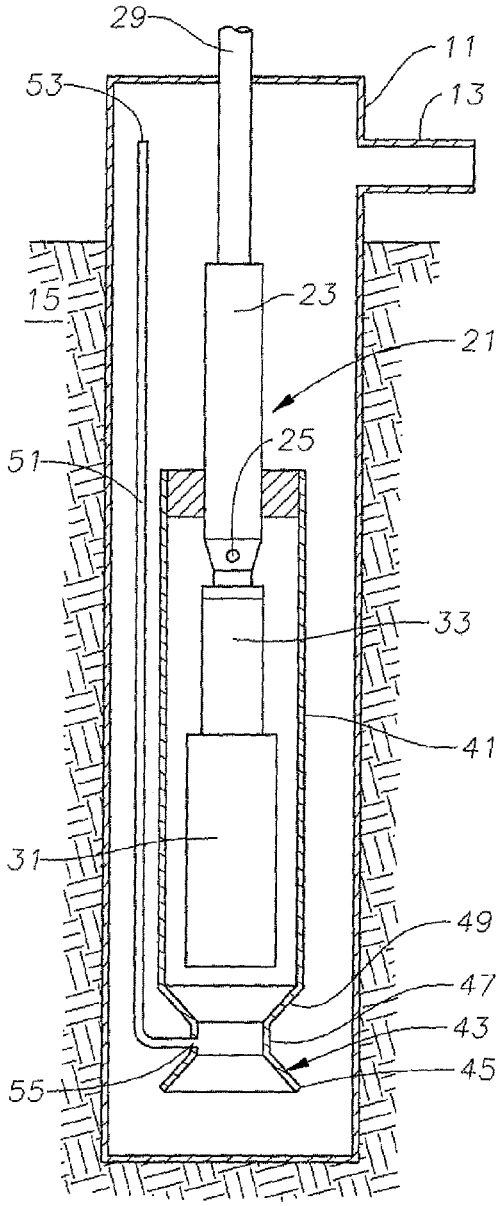
FIG. 2 is a schematic sectional view of a caisson pump apparatus constructed in accordance with a second embodiment of the invention.

In the embodiment of FIG. 2, the components that are the same as in FIG. 1 have the same reference numerals. Shroud 41 differs from shroud 17 in that its inlet comprises a venturi 43. Venturi 43 has a converging lower or upstream section 45 that joins a throat or central section 47 of reduced but constant diameter. Central section 47 leads to a downstream diverging section 49. Venturi 43 causes a reduced pressure in central section 47. Eduction tube 51 has its upper end 53 positioned above shroud 41, as in the first embodiment. The lower end 55 of eduction tube 51 joins venturi central section 47.

The second embodiment operates in the same manner as the first embodiment by drawing a portion of the gas cap continuously down through eduction tube 51 into shroud 41. In this embodiment, the gas mixes with the liquid as it flows upward around motor 31 and into pump intake 25.

Figure 3:
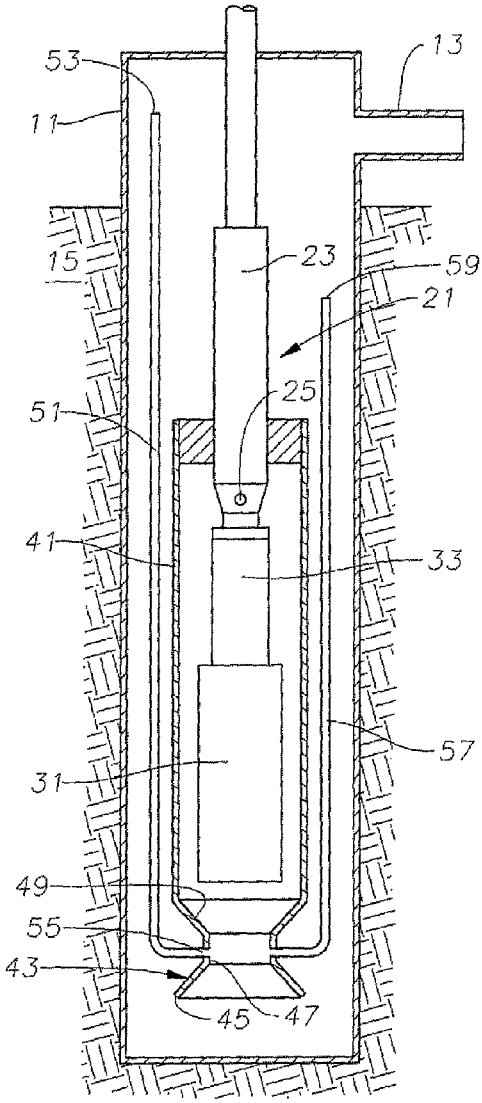
FIG. 3 is a schematic sectional view of a caisson pump apparatus constructed in accordance with a third embodiment of the invention.

In the embodiment of FIG. 3, a second eduction tube 57 is employed along with first eduction tube 53. Eduction tube 57 also extends alongside shroud 41 and has its lower end connected with venturi central section 47. Second eduction tube 57 increases the amount of gas being drawing from the gas cap. Second eduction tube 57 may have its upper end at a different elevation from first eduction tube 51, if desired. This results in second eduction tube 57 drawing gas from a different portion of caisson 11. If the liquid level rose to a point above second eduction tube upper end 59, first eduction tube upper end 53 might be high enough to continue drawing gas. Second eduction tube 57 is shown added to the embodiment of FIG. 2. Alternatively, it could be added to the embodiment of FIG. 1 as well.

Figure 4:
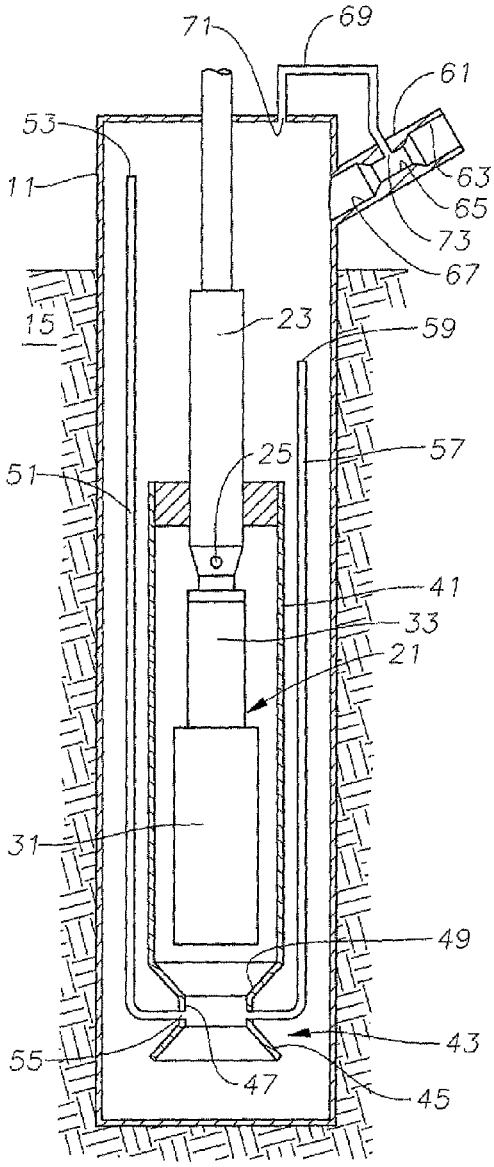
FIG. 4 is a schematic sectional view of a caisson pump apparatus constructed in accordance with a fourth embodiment of the invention.

In the embodiment of FIG. 4, a caisson venturi 61 is provided at the inlet of caisson 11. Caisson venturi 61 has an upstream section 63 that converges, a central or throat section 65 of smaller diameter, and a downstream section 67 that diverges. An eduction conduit 69 has an inlet end 71 connected to an upper portion of caisson 11. The outlet of eduction tube 69 is located at venturi central section 65.

In the operation of the embodiment of FIG. 4, the well fluid flowing into caisson 11 is conditioned by venturi 61 in that gas collecting in the upper portion of caisson 11 will be metered back into the fluid flowing through caisson venturi 61 to re-entrain the gas in the fluid flow. The gas will be dispersed into smaller bubbles as it is re-entrained. The smaller bubbles are more readily pumped by pump 23 than large slugs of gas. Caisson venturi 61 causes a pressure drop that recirculates some of the accumulated gas back into the incoming liquid stream. Although the embodiment of FIG. 4 is shown as containing the same eduction tubes 51, 57 as in FIG. 3, the FIG. 4 embodiment could also be employed with the FIG. 1 or the FIG. 2 embodiments. Eduction conduit 69 can condition the gas in the well fluid in all three of the embodiments.

The invention has significant advantages. By continuously drawing off a small amount of the gas cap, the size of the gas cap is maintained within the caisson at a minimum dimension. Limiting the size of the gas cap prevents the liquid level from dropping so low that such large slugs of gas could enter the shroud and cause gas locking of the pump.

While the invention has been shown in only a few of its forms, it should be apparent to those skilled in the art that it is not so limited but is susceptible to various changes without departing from the scope of the invention.

The invention claimed is:

1. A sea floor pump apparatus for installation in a caisson having an inlet at an upper end for receiving a flow of fluid containing gas and liquid, the apparatus comprising:

a shroud for location within the caisson, the shroud having an inlet at a lower end for receiving fluid flowing into the caisson;

an electrical submersible pump assembly mounted within the shroud, the pump assembly including a centrifugal pump having an intake within the shroud downstream of the inlet of the shroud for drawing fluid from an interior of the shroud into the pump, the pump having a discharge pipe for discharging the fluid out of the caisson; and at least one eduction tube having an open upper end extending exterior of the shroud for location within an upper portion of the caisson and an open lower end in fluid communication with an interior portion of the shroud at or below the intake of the pump for drawing gas that collects in the caisson into the intake of the pump.

2. The apparatus according to claim 1, wherein the lower end of the tube extends through a wall portion of the caisson and joins the intake of the pump assembly.

3. The apparatus according to claim 1, wherein the tube extends alongside the shroud and has its lower end at the inlet of the shroud below the intake of the pump.

4. The apparatus according to claim 1, wherein the inlet of the shroud comprises:

a venturi having an upstream converging portion, a central portion of reduced diameter, and a downstream diverging portion; and wherein the lower end of the tube extends to the central portion of the venturi.

5. The apparatus according to claim 1, wherein the upper end of the tube is located above the shroud.

6. The apparatus according to claim 1, wherein said at least one tube comprises:

first and second tubes, the first tube having an upper end at a higher elevation from the shroud than the second tube.

7. The apparatus according to claim 1, wherein the tube has a flow area substantially smaller than a flow area of the inlet of the shroud.

8. The apparatus according to claim 1, wherein the tube has an inner diameter substantially smaller than an inner diameter of the discharge pipe.

9. A sea floor fluid pump apparatus, comprising:

a caisson installed in a sea floor and having an inlet at an upper end for receiving a flow of fluid containing gas and liquid;

an electrical submersible pump assembly within the caisson, the pump assembly including a centrifugal pump having an intake and a discharge pipe extending sealingly through an upper portion of the caisson;

a shroud surrounding the pump assembly within the caisson, the shroud having an upper end sealed around the pump assembly above the intake of the pump and an inlet at a lower end for receiving fluid flowing into the caisson, the downward flow of the fluid around the shroud causing at least some of the gas contained therein to separate and collect in an upper portion of the caisson, the intake of the pump being in fluid communication with an interior of the shroud; and at least one tube having an open upper end above the shroud within the upper portion of the caisson and an open lower end in fluid communication with an interior portion of the shroud for drawing gas that collects in the caisson into the intake of the pump, the lower end of the tube being at an elevation no higher than the intake of the pump.

10. The apparatus according to claim 9, wherein the lower end of the tube extends through a wall portion of the shroud and is coupled directly to the intake of the pump above the inlet of the shroud.

11. The apparatus according to claim 9, wherein the tube extends alongside the shroud and has its lower end at the inlet of the shroud.

12. The apparatus according to claim 9, wherein the inlet of the shroud comprises:

a venturi having a lower converging portion, a central portion of reduced diameter, and an upper diverging portion; and wherein the lower end of the tube extends to the central portion of the venturi.

13. The apparatus according to claim 9, wherein said at least one tube comprises:

first and second tubes, the first tube having an upper end at a higher elevation within the caisson than the second tube.

14. The apparatus according to claim 9, wherein the tube has an inner diameter substantially smaller than the discharge pipe of the submersible pump assembly.

15. The apparatus according to claim 9, wherein the tube has a flow area substantially. smaller than a flow area of the inlet of the shroud.

16. The apparatus according to claim 9, wherein the inlet of the caisson comprises:

a venturi having an upstream converging portion, a central portion of reduced diameter, and a downstream diverging portion; and wherein a recirculation conduit extends from the central portion of the venturi to the upper portion of the caisson for educting gas collecting in the upper portion of the caisson and re-entraining the gas with the fluid flowing into the caisson.

17. A method of pumping a well fluid from a sea floor, comprising:

(a) providing a caisson in the sea floor;

(b) mounting a shroud around an electrical submersible pump assembly that includes a centrifugal pump having an intake within the shroud, the shroud having an inlet at a lower end of the shroud;

(c) connecting at least one tube to the shroud such that an upper end of the tube is exterior of the shroud and the lower end of the tube is in fluid communication with an interior portion of the shroud at or below the intake of the pump;

(d) installing the shroud, the pump assembly and the tube in the caisson;

(e) flowing a fluid containing a gas and liquid into the caisson and operating the pump assembly, causing the fluid to flow downward around the shroud and up the inlet of the shroud into the intake of the pump, which discharges the fluid out of the caisson at a greater pressure, the downward flow of the fluid in the caisson causing some of the gas to separate and collect in an upper portion of the caisson; and (f) educting gas collected in the upper portion of the caisson through the tube into the shroud and into the intake of the pump.

18. The method according to claim 17, further comprising:

maintaining a level of the liquid in the caisson below the upper end of the tube.

19. The method according to claim 17, further comprising:

educting a portion of the gas collected in the upper portion of the caisson back to an inlet of the caisson and re-entraining the gas with the fluid flowing into the caisson.

20. The method according to claim 17, wherein step (c) comprises:

positioning the upper end of the tube above the shroud.

* * * * *